US008985585B2

(12) United States Patent
Hodge

(10) Patent No.: US 8,985,585 B2
(45) Date of Patent: Mar. 24, 2015

(54) THERMAL TARGET SYSTEM

(76) Inventor: Bruce Hodge, Greenfield, NY (US)

( * ) Notice: Subject to any disclaimer, the term of this patent is extended or adjusted under 35 U.S.C. 154(b) by 1392 days.

(21) Appl. No.: 11/853,574

(22) Filed: Sep. 11, 2007

(65) Prior Publication Data

US 2009/0194942 A1 Aug. 6, 2009

Related U.S. Application Data

(60) Provisional application No. 60/869,240, filed on Dec. 8, 2006, provisional application No. 60/825,174, filed on Sep. 11, 2006.

(51) Int. Cl.
*F41J 2/02* (2006.01)
*F41J 5/02* (2006.01)
*F41J 5/04* (2006.01)

(52) U.S. Cl.
CPC .... *F41J 2/02* (2013.01); *F41J 5/02* (2013.01); *F41J 5/041* (2013.01)
USPC ..... 273/348.1

(58) Field of Classification Search
CPC ..... F41J 2/02; F41J 5/041
USPC ..... 273/348.1
See application file for complete search history.

(56) References Cited

U.S. PATENT DOCUMENTS 4,279,599 A * 7/1981 Marshall et al. ..... 273/348.1
4,346,901 A * 8/1982 Booth ..... 273/348.1
4,524,386 A * 6/1985 Scott ..... 348/164
4,633,068 A 12/1986 Grise
4,659,089 A 4/1987 Rosa
4,792,142 A * 12/1988 Davies ..... 273/348.1
5,065,032 A * 11/1991 Prosser ..... 250/495.1
5,296,270 A * 3/1994 Prosser ..... 427/448
5,901,959 A * 5/1999 Tessiot ..... 273/348.1
5,969,369 A * 10/1999 Fogarty ..... 250/495.1
6,037,748 A * 3/2000 Yee et al. ..... 320/127
7,377,517 B2 * 5/2008 Andren et al. ..... 273/348.1
2005/0237528 A1 10/2005 Oldham et al.

(Continued)

FOREIGN PATENT DOCUMENTS

WO WO 2004/099706 A1 11/2004

OTHER PUBLICATIONS

International Search Report from corresponding PCT International Application No. PCT/US07/78160 filed Sep. 11, 2007, dated Mar. 20, 2008.

(Continued)

*Primary Examiner* — Jay Liddle
(74) *Attorney, Agent, or Firm* — Heslin Rothenberg Farley & Mesiti P.C.; Nicholas Mesiti, Esq.; Victor A. Cardona, Esq.

(57) ABSTRACT

A thermal signal generating device, including at least two parallel buss bars operable for carrying a current and a heating element having at least a first region and a second region. The heating element includes a plurality of horizontal traces and a plurality of vertical traces. Widths of each of the plurality of horizontal and vertical traces may be greater in a first region of the heating element than in a second region of the heating element, allowing for a gradient heat differential to be emitted by the heating element.

32 Claims, 18 Drawing Sheets

(56) References Cited

U.S. PATENT DOCUMENTS

| | | | | |
|---|---|---|---|---|
| 2006/0076736 | A1 | 4/2006 | Hodge | |
| 2007/0160960 | A1* | 7/2007 | Manard et al. | 434/11 |
| 2007/0205560 | A1* | 9/2007 | Hebble | 273/348.1 |
| 2008/0296842 | A1* | 12/2008 | Novak et al. | 273/348.1 |

OTHER PUBLICATIONS

Extended European Search Report, dated Oct. 29, 2012, from corresponding European Application No. 07842244.1.

* cited by examiner

THERMAL TARGET SYSTEM

CROSS-REFERENCE TO RELATED APPLICATIONS

This application claims the benefit of U.S. Provisional Patent Application No. 60/869,240, filed on Dec. 8, 2006. entitled "Thermally Gradient Programmable Target". This application is also related to U.S. Pat. Nos. 5,516,113 and 7,207,566, the entire contents of each of which are incorporated herein by reference. This application also claims the benefit of U.S. Provisional Patent Application No. 60/825,174 entitled THERMALLY GRADIENT TARGET, filed on Sep. 11, 2006, the disclosure of which is incorporated herein by reference in its entirety.

COPYRIGHT NOTICE

A portion of the disclosure of this patent document contains material which is subject to copyright protection, The copyright owner has no objection to facsimile reproduction by anyone of the patent document or the patent disclosure, as it appears in the Patent and Trademark Office patent file or records, but otherwise reserves all copyright rights whatsoever.

TECHNICAL FIELD

The present application relates to methods and apparatuses for generating gradient thermal signatures and a computer-implemented approach for detecting and retrieving positional information from a thermal target or standard target using either penetration detection or laser detection.

BACKGROUND

There is a need to produce thermal targets that emulate an original source's thermal signature with a much greater degree of accuracy then is available to date. Along with thermal signature accuracy there is a need to reduce power consumption of the battery operated thermal targets. A need exists for methods and apparatuses utilizing Power On Demand ("POD") target power units ("TPU") that only deliver power when the target is in use. Further, a need exists for methods and apparatuses operable to use inkjet, digital, and other printing devices to print resistive and conductive inks in a thermal target instead. The present invention addresses these issues and more.

SUMMARY

The thickness of resistive materials may be varied to achieve a gradient thermal signature. Further, a photo resistive matrix can be used to determine laser impacts on a thermal or standard target. A multiple print head printer, a hybrid print head printer, or a similar device may be utilized to print these types of targets.

DETAILED DESCRIPTION

A Resistive Matrix Target ("RMT") is shown in U.S. Pat. No. 5,516,113, incorporated herein by reference in its entirety.

Figure 1:
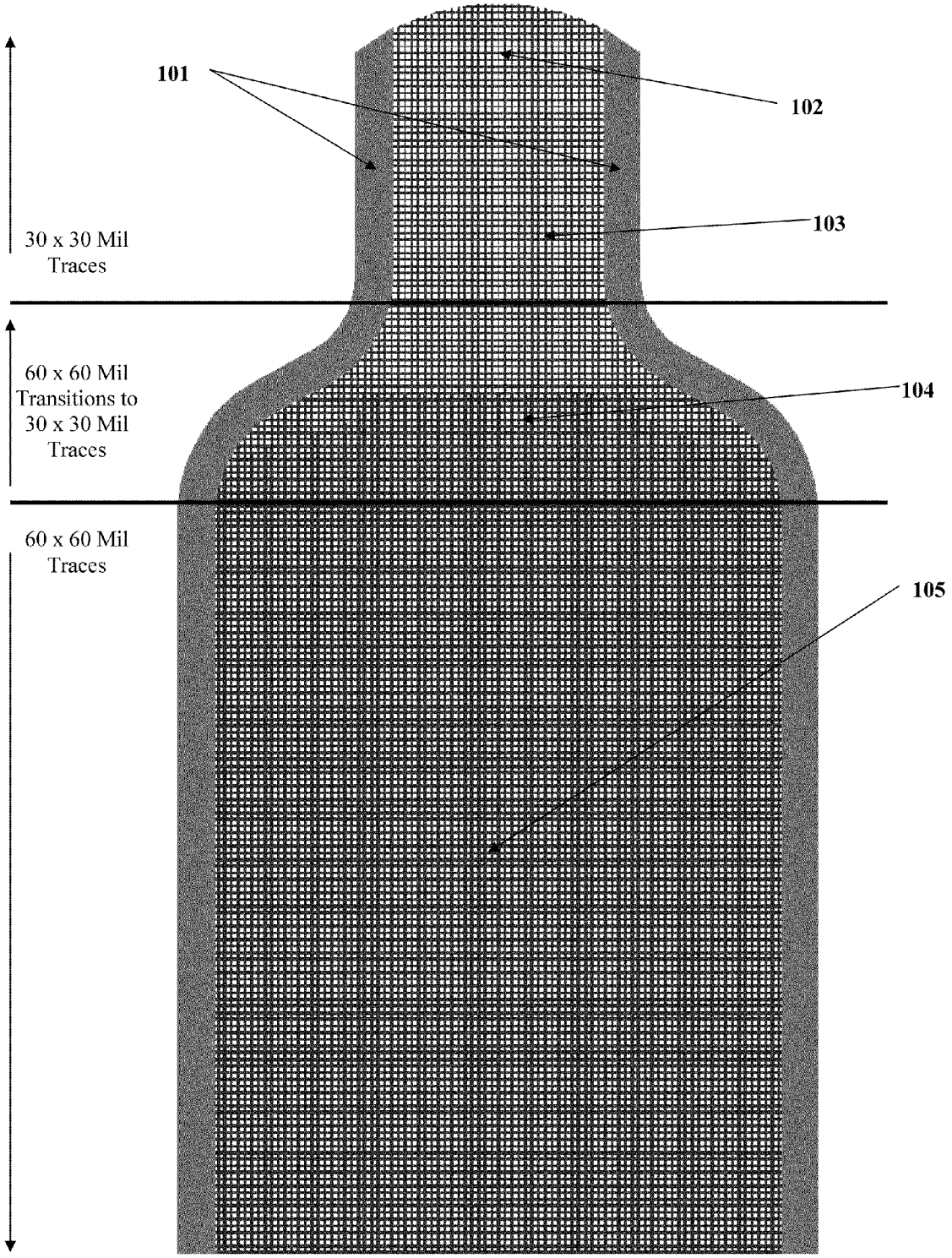
FIG. 1 is a diagram showing a resistive matrix with varying trace widths to produce a gradient thermal target in one embodiment.

By utilizing two parallel buss bars as shown in FIG. 1-101, a thermal signature generator that can create a gradient thermal signature is possible. The graphic colloidal suspension coating or resistive/conductive ink may be bonded to a thin sheet of plastic to form a heating element. The heating element may have horizontal and vertical traces 102 that are wider on the bottom 105 then at the top 103. This variation in trace widths allows for a gradient heat differential to be emitted by the heating element. The mid section transitions from 60 mil wide traces to 30 mil traces 104. The two busses of conductive ink and/or conductive foil 101 are used to supply power to the target. Current flows across the grid from one buss to the other. A direct current ("DC") or alternating current ("AC") can be placed across the buss to supply power to the grid. A UV protective dielectric layer can be overlaid on top of the resistive/conductive ink to provide protection against harsh environmental elements and to eliminate a shock hazard. A thermally-insulative layer like thin film polyethylene foam padding can be bonded to the back to prevent the support backing or base from absorbing thermal energy from the heating element thereby reducing the amount of energy needed to heat it. By varying the trace widths of the resistive/conductive ink traces the current flow and therefore thermal response can be more accurately controlled. The resistive segments do not necessarily need to be continuously interconnected as shown in vertically interconnected traces of sections 103, 104, 105. The vertical traces at the division lines may be removed to create 3 independent segments: a head segment 103, a shoulder segment 104 and a body segment 105 which may be electrically independent of each other and which may be produced with three or more individual silk-screen masks as well as a unique resistive ink blend of carbon black resistive ink and silver conductive ink for each screen to achieve the desired resistance and therefore temperature.

Figure 2:
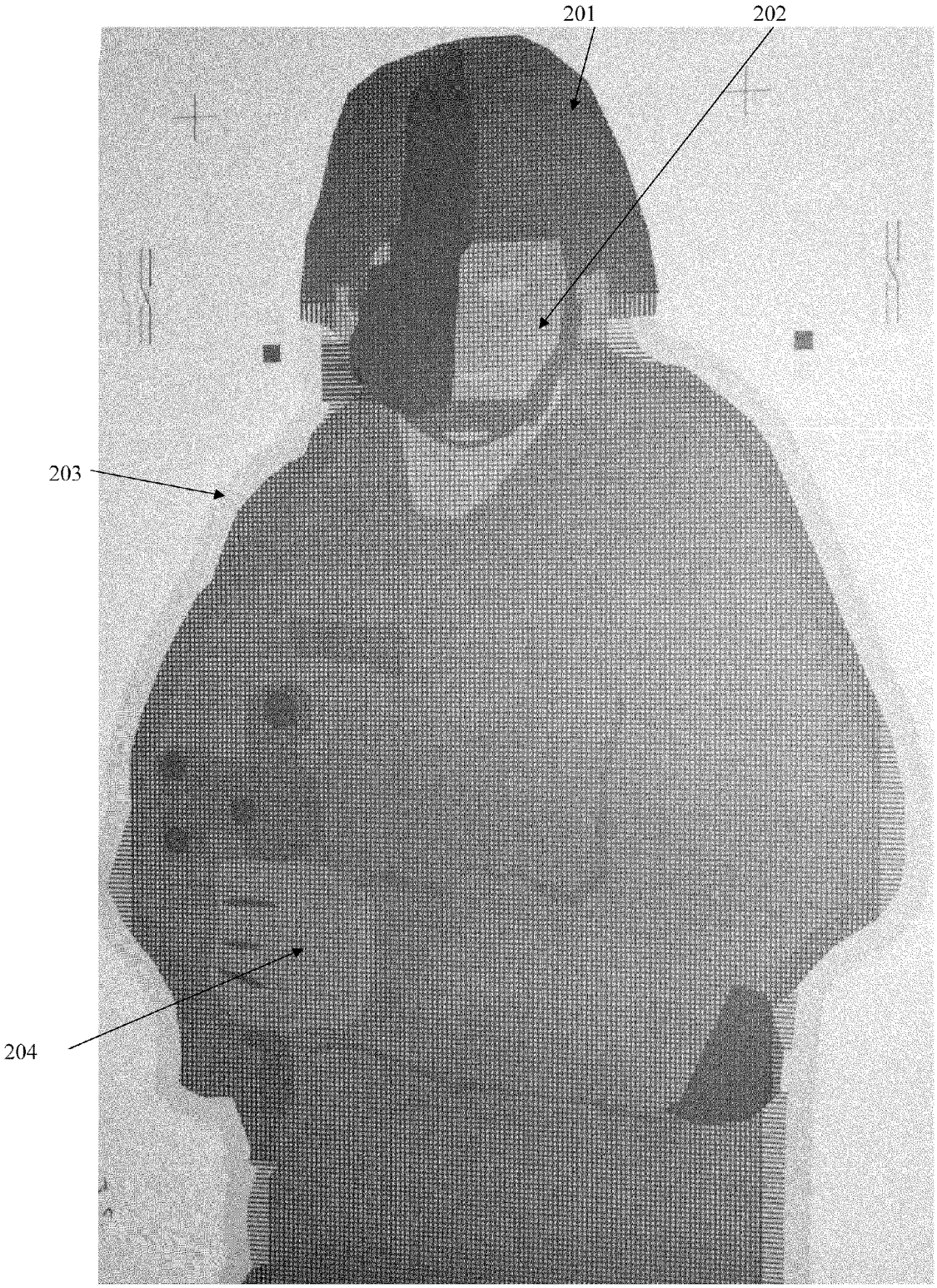
FIG. 2 shows an embodiment of a resistive matrix thermal membrane with more complex sections of varying trace widths and its silver power busses.

FIG. 2 shows a resistive matrix gradient thermal target that has numerous sections of different trace widths. The helmet 201 has significantly wider traces then the face 202 or the hands 204. Therefore it will have a lower resistance and be cooler than the face or hands. The conductive buss 203 which is made of pure silver ink traces supplies the power to the resistive matrix. This target can be designed to run on battery power by adjusting the resistive/conductive ink ratio so that the overall resistance is low. An AC target may have an overall resistance significantly higher in order to generate enough energy to present a realistic thermal signature. The dielectric coating may be flood coated over the entire target except for a small area at the bottom of each power buss used to attach the power connectors. Registration of the masks may be used is to ensure that the alignment of both the resistive matrix, the conductive power busses, and the protective dielectric align with each other. As would be apparent to one skilled in the art of plastics manufacturing and printing, other suitable techniques for producing this structure are possible without deviating from the essence or spirit of the invention of the present application.

Figure 3:
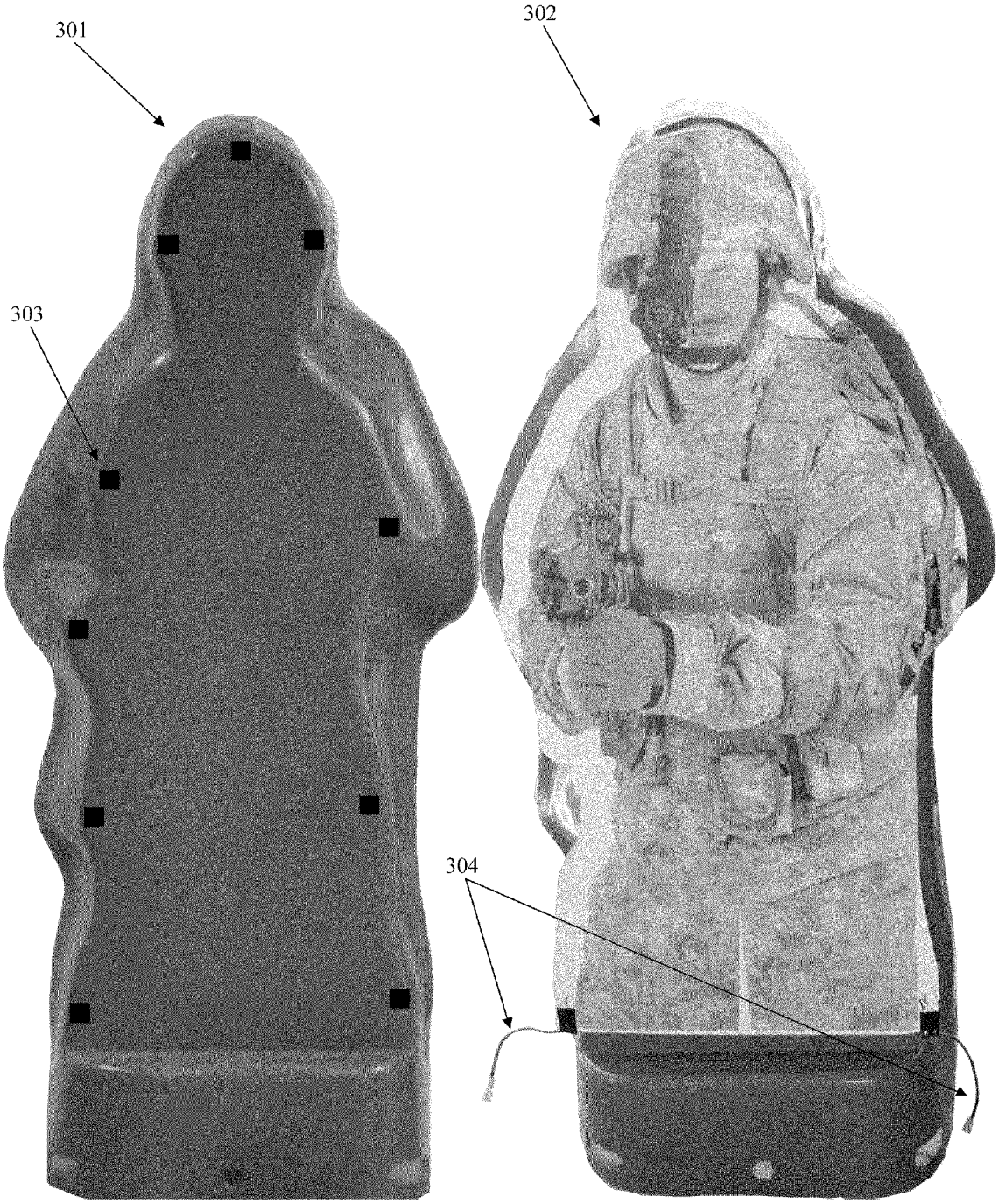
FIG. 3 shows an embodiment of a modified Fat Ivan target along side a CID realistic thermal target.

Fat Ivan High Density Polyethylene ("HDPE") targets could be modified to have a smooth front surface as shown in FIG. 3-301 so that the thermal heating membrane could be temporarily bonded to the face of the HDPE target using VELCRO (™), snap rivets, staples or a similar type of bonding method. This would allow for easy replacement of the heating element and reduce a cost of having to fabricate a heating membrane attached with a HDPE backing. The modified Fat Ivan 301 with no heating element attached can still function as a stand alone target. It will still retain the HDPE rigidity robustness as well as the large number of sustainable hits (.about.=4,000) that the current Fat Ivan target possess. A range operator would only have to press the thermal heating element, with thin insulating foam backing, onto mating VELCRO (™) tabs 303, which are placed around the fat Ivan's front surface, and hook up power buss wires 304 install a new heating element. In an exemplary embodiment, 2 power buss wires 304 are used, although any suitable number of power buss wires may be utilized. A graphic image of the target subject (e.g., Friend, Foe, or Neutral) can be laminated on top of the thermal membrane shown in FIG. 2 to create a Combat Identification realistic target shown in FIG. 3-302. The (Friend) subject graphic image that is laminated onto the thermal membrane FIG. 2 maps one to one so that the thermal image generated by the resistive thermal membrane simulates the exact thermal signature of the graphic image. The image can be printed on thin PVC or Vinyl sheets using a digital printer or silk screened. The image may be aligned with resistive thermal membrane to ensure alignment of the thermal signature with the graphic image. Again one skilled in the art of plastics manufacturing and printing could produce a multitude of different techniques for achieving this, without deviating from the essence or spirit of the invention of the present application.

In another exemplary embodiment, the RMT target in itself can be made to emit a thermal signature by reducing the resistive segment's resistance and lowering the exterior sense resistor's resistance. This lower resistance would cause enough energy to be dissipated across the matrix and generate the desired thermal signature. The resistances of the resistive segments could be configured with varying resistance to create a gradient heating element when the mathematical model used to model the resistive matrix is changed accordingly to reflect those resistances. Also a contour of the resistive matrix could be configured so that the heating element is modeled after the desired source's thermal image. This would allow an RMT target to both locate the X-Y position of penetration and act as a thermal target using the same resistive membrane.

Figure 4:
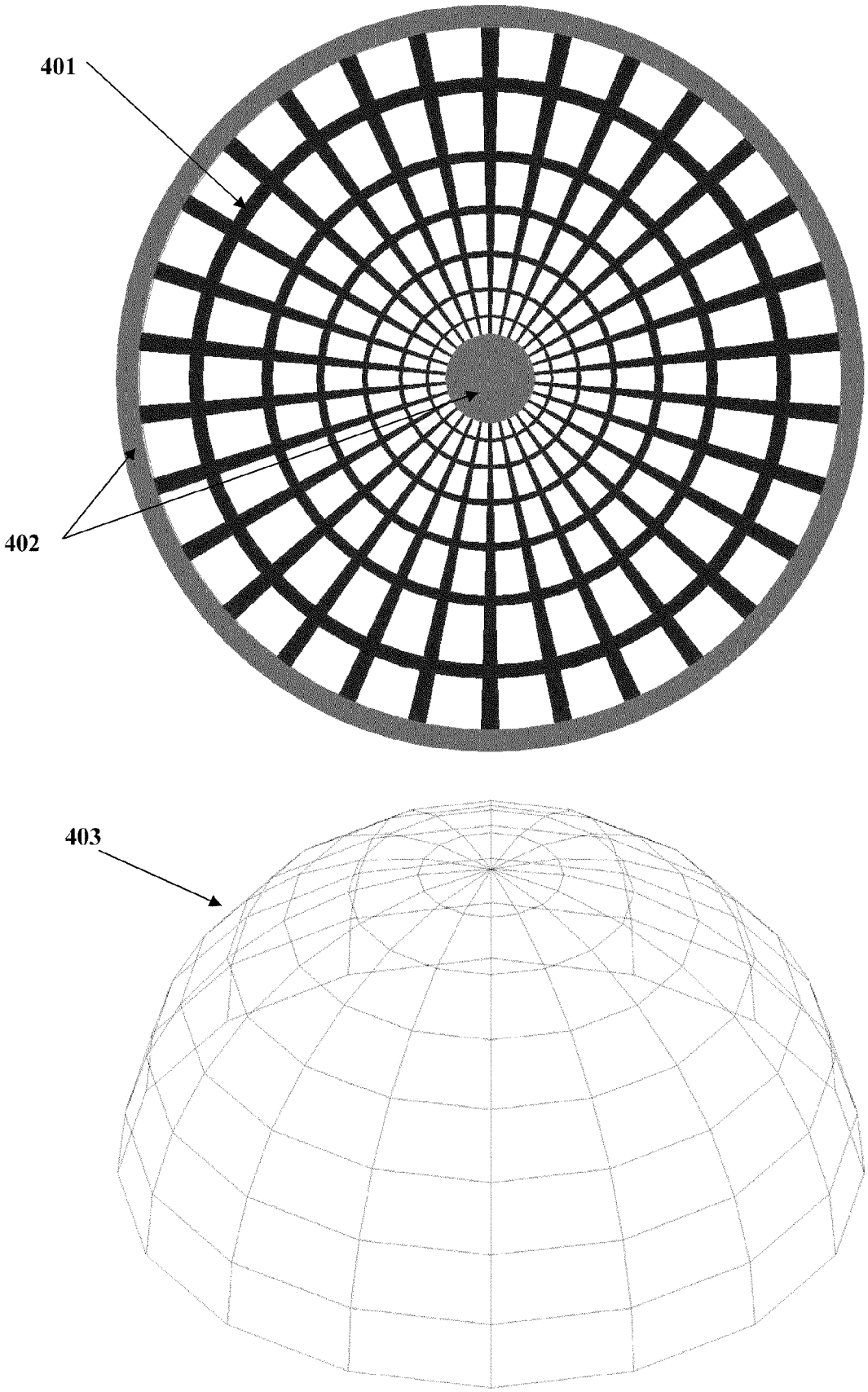
FIG. 4 shows a non linear matrix thermal membrane with varying trace widths used to generate a thermal image over a curved body in one embodiment.

In another exemplary embodiment, the traces could be formed in a non-linear matrix pattern and still perform the same function. FIG. 4 shows a gradient heating element formed from concentric circular traces 401. The power may be applied across the 2 busses 402 as shown on the inner and outer most circular traces. This type of pattern could be used to conform to a dome type target 403. One skilled in the art of silk screening could produce a multitude of different pattern types and not deviate from the core essence or spirit of the invention of the present application.

Figure 5:
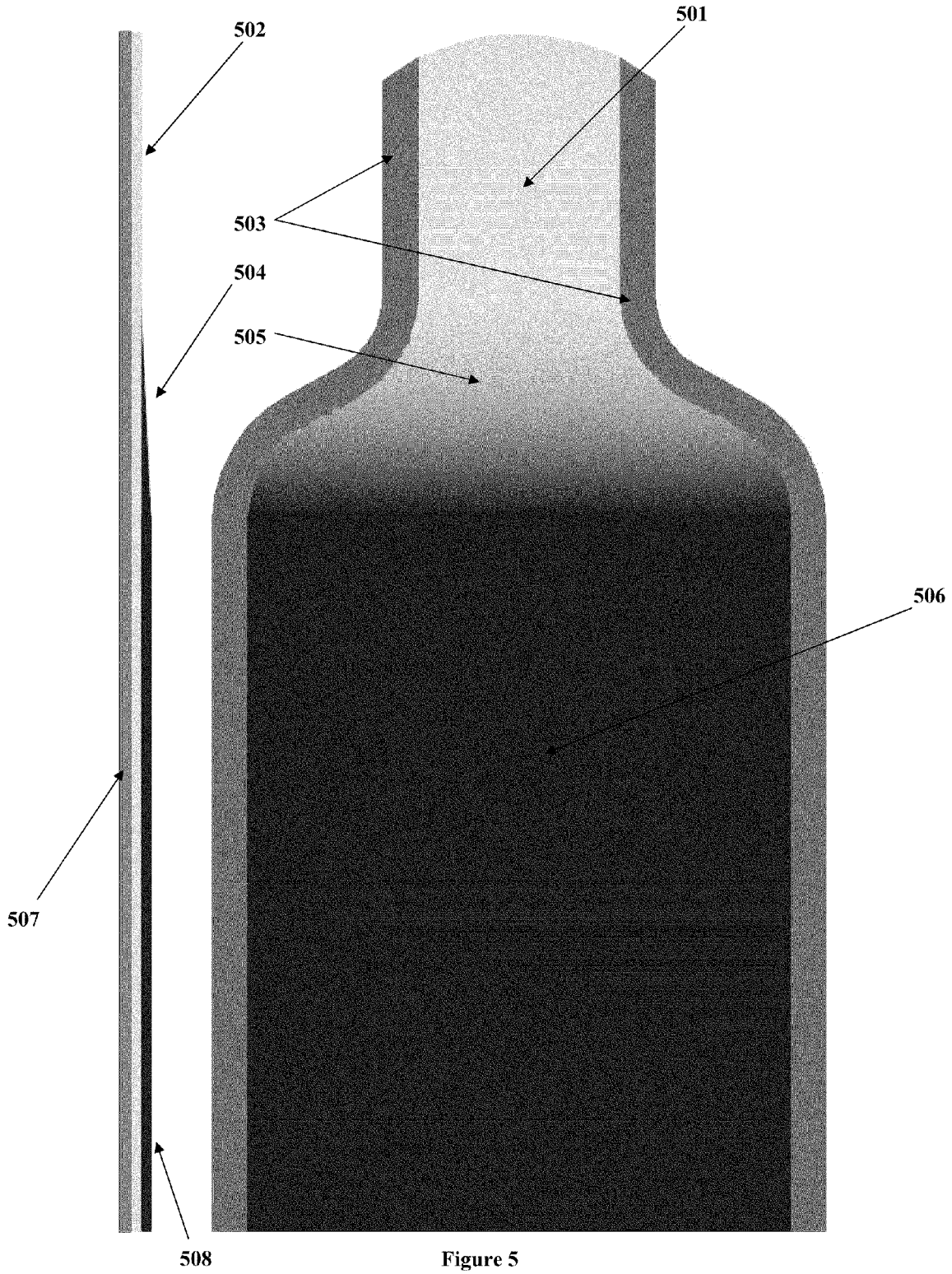
FIG. 5 shows a gradient thermal target created using cascaded flood coated layers with varying thickness one embodiment.

In another exemplary embodiment, a silkscreen mask could be created with varying thickness to allow a flood coated pattern to vary the resistive/conductive ink depth. Once cured this variance in resistive/conductive ink thickness creates a gradient heating element. FIG. 5 shows how a similar thermal gradient target could be created using flood coated screens of resistive/conductive ink. The conductive ink or foil power busses 503 supply power across the flood coated resistive/conductive coating. The head part of the silhouette 501 has the thinnest thickness of resistive/conductive coating and the narrowest distance between the power busses. The shoulder section 505 has a gradient thickness going from thinner to thicker, moving down the target to the base section. The base section 506 has the thickest section. A side view of the target thickness can be seen to the left of the silhouette. The first layer of resistive/conductive colloidal suspension coating or ink can be formed by using a single flood coat mask 502 covering the entire silhouette and bonds directly to the plastic substrate. Then to achieve the base thickness 508 a second pass of flood coating adding another layer of resistive/conductive coating can be bonded to the first layer 507. A mask that has variable thickness can be used to produce the gradient thickness 504 in the shoulder section 505 of the silhouette. A series of graduated thickness in screens and or successive passes could be use to accomplish the same task of varying the resistive/conductive coating thickness. A mask containing a resistive matrix with varying trace widths shown in 104 could be overlaid onto the flood coated second layer to achieve the same results. A composite thermal target can be created by utilizing insulative, conductive, and resistive inks combined with insulative, conductive, and resistive plastic For example, a tank target could be created with conductive plastic panels thermal formed onto an electrically insulative plastic base. The electrical connections to the resistive plastic panels could be created using a conductive ink coating onto the electrically insulative plastic and connected to the panels to form the power busses. Another technique may include 2 different thermal signatures of tanks interlaced or overlaid upon each other. When one set of heating elements are active the target is has a thermal signature of a Friendly tank target. Once the target is laid down in the Stationary Armored Target ("SAT") or Moving Armored Target ("MAT") the other heating elements may be energized/de-energized accordingly and the target rises up now with a Foe thermal signature. For example when presentation of a thermal image of an enemy T-72 is desired the T-72 thermal membrane layer may be energized, and/or when presentation of a friendly M1 Abrams tank is desired the T-72 thermal layer may be deenergized and the M1 Abrams tank layer may be energized.

In another exemplary embodiment a friend/foe target could be accomplished by adhering a friend thermal membrane to one side of the HDPE or plywood backing and have a foe thermal membrane adhered to the other side of the HDPE or plywood backing. Both thermal membranes could be powered simultaneously and whichever target is facing the shooter would be determine whether the target is friend or foe, or for greater efficiency only the target facing the shooter could be powered. This may significantly extend the functionality of simulation scenarios possible and require soldiers to more accurately acquire their target before engaging, FIG. 6 could be created using a conductive plastic silhouette base with the hot barrel heating element composed of a 10 mil polycarbonate sheet with resistive/conductive ink formed into the shape of the gun barrel 602. This resistive ink gun barrel (thermal image generator) could be laminated with pressure sensitive adhesive to the back or the front of the base target creating a resistive plastic/resistive ink Friend/Foe target. If the circuit for the base target is energized and the gun circuit is de-energized it would be considered an unarmed (Friend) target. If both the base target circuit and the gun circuit are energized it would be considered and armed (Foe) target. A friend/foe target could also be created by using layered thermal membranes on individual circuits. A thermal signature of an armed threat could be on one layer, silhouette and weapon, and a non-armed thermal signature would be on another layer. The layer desired to be displayed may be turned on and the entire signature is generated. One of ordinary skill in the art will recognize that there are many combinations of these types of techniques for achieving this while not deviating from the essence or spirit of the invention of the present application.

Figure 6:
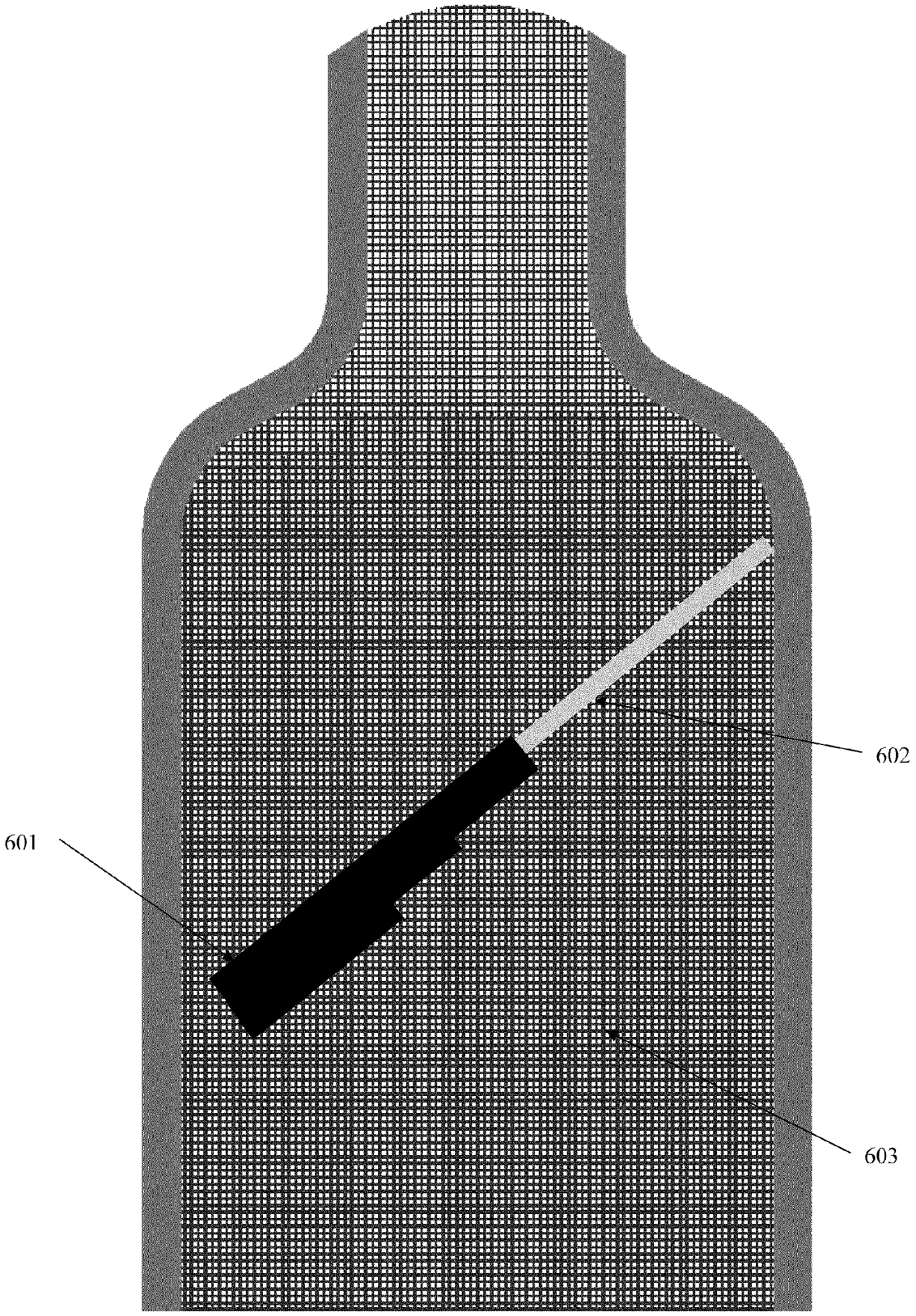
FIG. 6 shows a multi-layered gradient thermal target in one embodiment.

In another embodiment a friend/foe target could be achieved by controlling the currents to either a resistive ink or a resistive plastic thermal image generator shaped as a visible weapon or unique thermal signature needed to identify friend from foe. Again FIG. 6 shows a resistive matrix ink target with a thermal insulative coating 601 and a high temperature generating resistive coating 602 that is isolated from the base resistive coating 603 using an inert or non-electrically conductive dielectric coating or simply placing the resistive layer on the back side of the target's substrate. The power circuit may run down the top of the electrically insulative dielectric layer or down the back side. This multilayered target could be excited using a DC, AC, or Pulse Width Modulated ("PWM") power source. Each layer can be turned on as need to represent the proper threat. For example, in FIG. 6 the hot barrel thermal signature generator could be jumpered to the entire target power source to create a Foe target. This target would be distinguishable by its hot barrel thermal signature superimposed on the human silhouette. If the hot barrel overlay is not jumpered to the target power source it would heat to the temperature of the base target and be considered a Friend target. Or a separate power source could be attached to the hot barrel simulator and allow remote control of the friend foe target. In the range simulation now a friend or foe target could be dynamically programmed into the target activation sequence such that what was at first a friend target has now become a foe target and visa-versa. There are many combinations of these types of techniques for achieving this invention while not deviating from the core essence or spirit of this invention. A gradient thermal target could also be constructed using resistive wire such as nickel-Chromium that is formed into a matrix mesh and press fitted into the shape of the Fat Ivan target. The resistive wire could contain varying resistive segments or more resistive wire could be added to the matrix to increase its conductivity. The resistive matrix wire mesh could then be embedded into the plastic of the Fat Ivan target. Either inside an injection mold or laminated inside 2 thermal formed sheets of E-Size or Fat Ivan targets to create a gradient thermal target.

Figure 7:
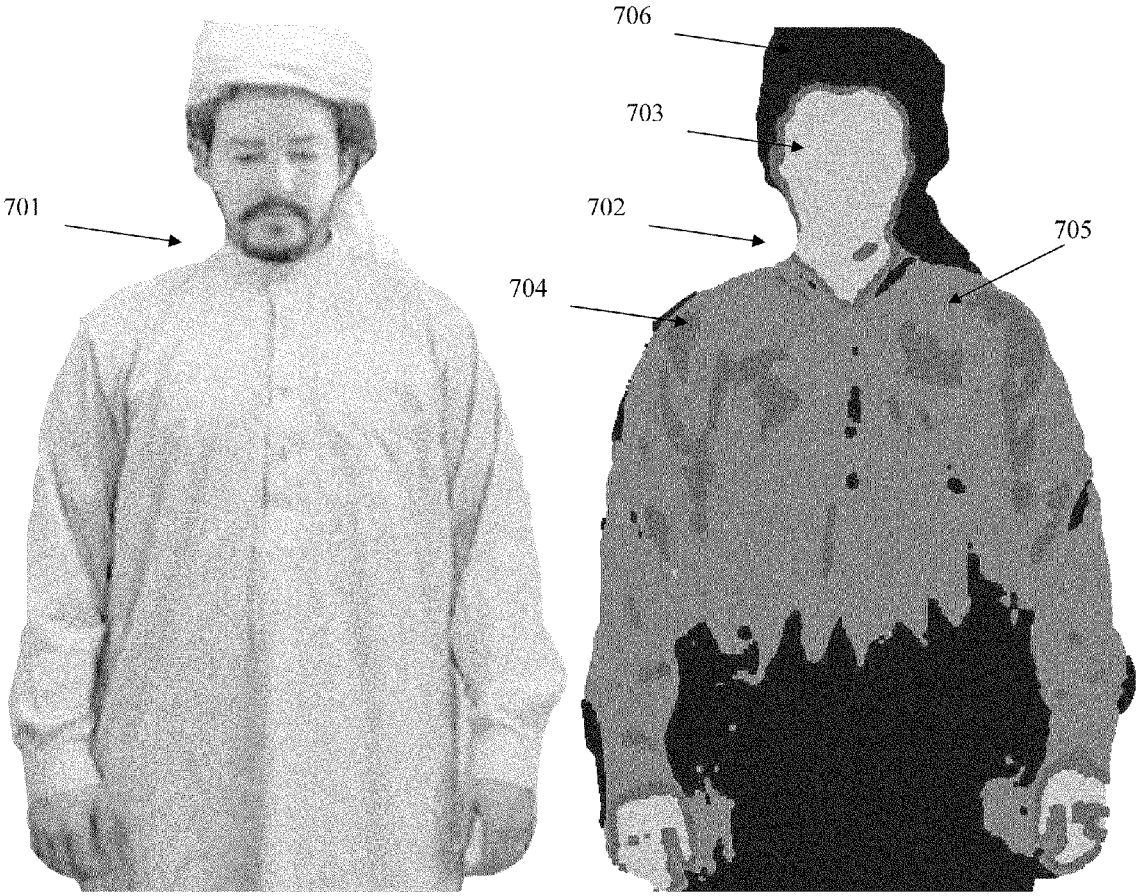
FIG. 7 shows a neutral subject and its corresponding thermal signature color map in one embodiment.

FIG. 7 shows a more complex (Neutral) realistic target 701 that could be created using multiple resistive flood coated masks. The entire silhouette sections (703-706) may be laid down on the first layer and bond direct to the plastic substrate. The second layer would bond the first layer and would contain sections 704, 705, 706. The third layer may bond the second layer and would contain sections 705, 706. Further, the final layer may bond to the third layer and may contain just section 706. This may make the thickness of each section running from thinnest to thickest sections 703 to 706. Since section 703 is the thinnest section it would be the warmest and since section 706 would be the thickest it would be the coolest section. A thin layer of polyethylene foam can be added to the back of the plastic substrate to insulate the heating element from the target backing. This heating element can be permanently bonded to a fat Ivan or E-Size target through lamination or thermal forming process or can be temporarily mounted using VELCRO (™) or snap rivets. Again, one skilled in art of silk screen printing and/or plastics could produce a multitude of different processes/methods and not deviate from the core essence or spirit of the invention of the present application.

Figure 8:
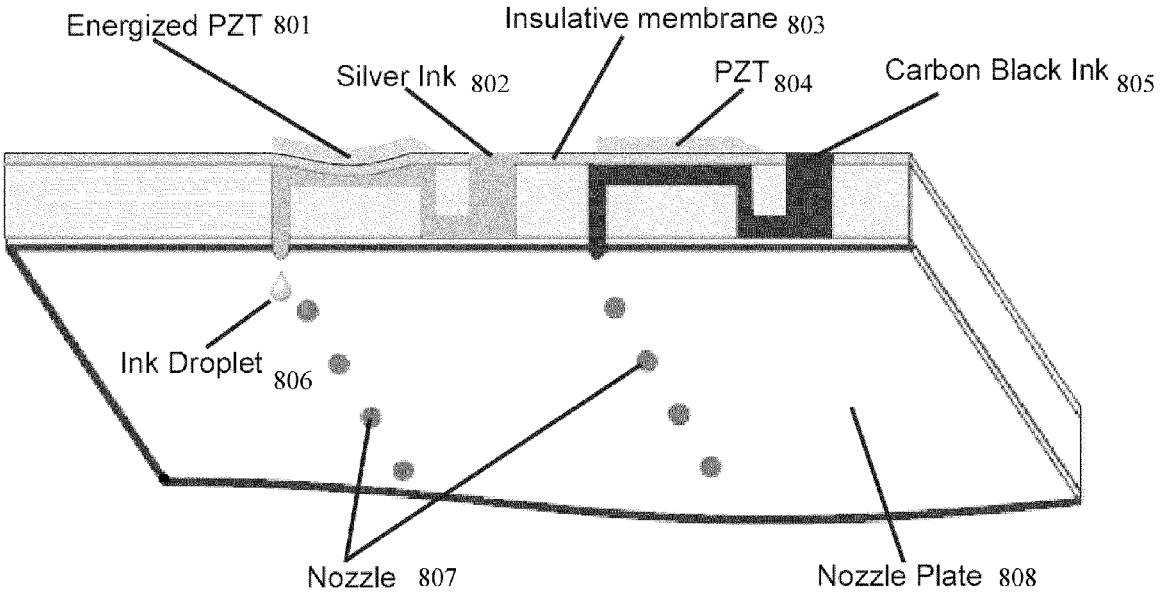
FIG. 8 shows a hybrid print head that has both silver and carbon black ink nozzles in one embodiment.

In another exemplary embodiment, a thermal target can be produced using a digital printer. A resistive/conductive ink print head may be created that can lay down a precise resistive layer by mixing both Carbon Black ink with Silver ink as it is traversing the substrate. Other suitable inks may be utilized. The resistive/conductive ink digital printer may include 1 or more piezoelectric print head(s) and a large X-Y flat bed or sheet feeding roller which the print head would navigate over using current stepper motor technology. One print head for the resistive ink (Carbon Black Based) and one print head for the conductive ink (Silver Based) and one print head with non-electrical dielectric. Or one hybrid head that combines both the carbon black ink with the silver ink and the dielectric together. The inks aqueous binder/solvent could require heat or Ultra Violet light to cure. FIG. 8 shows a diagram of the hybrid print head using piezoelectric print head technology. The silver ink 802 and carbon black ink 805 flow down from their respective reservoirs to their respective print head nozzle 807 where the ink droplet is force out of the nozzle plate 808 when the respective lead zirconium titanate ("PZT") transducer is energized. When the un-energized PZT 804 is energized it arches downward 801 and forces an ink droplet 806 out of the nozzle. The insulative Teflon© or rubber membrane 803 prevents the resistive and conductive inks from coming into contact with the PZT transducer while being flexible enough to allow the arched PTZ transducer to submerge into the ink reservoir forcing out the ink droplet. Each nozzle has its own dedicated PZT transducer and is controlled by the raster image processor ("RIP").

Figure 9:
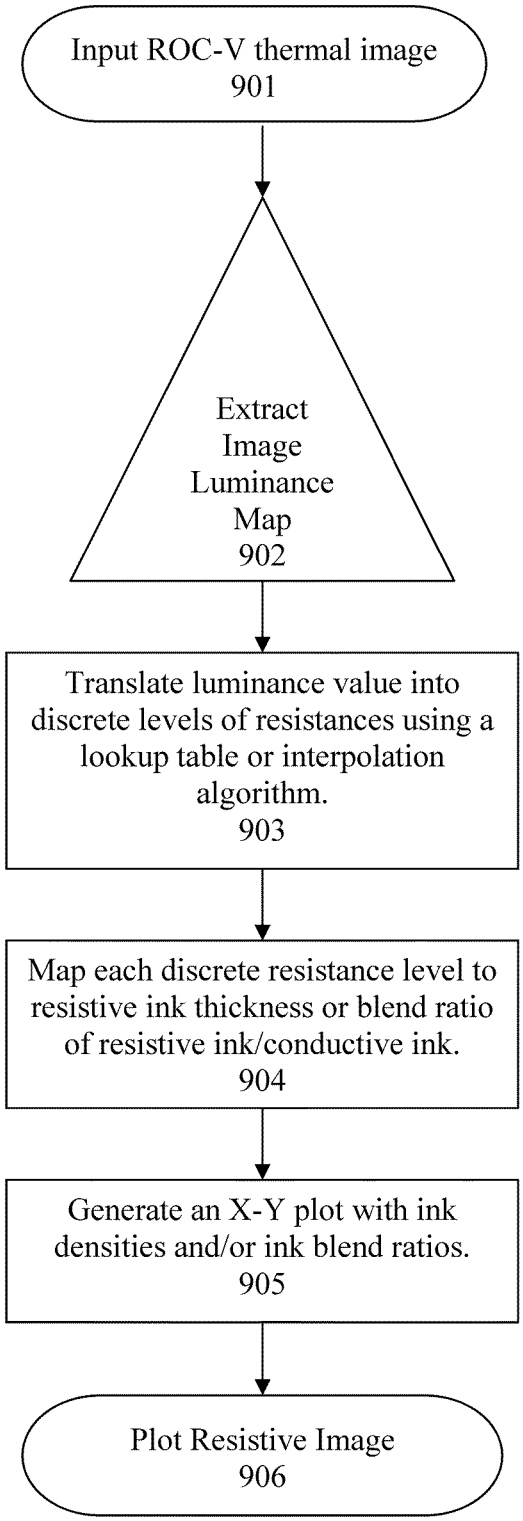
FIG. 9 is a flow chart showing the steps a Raster Image Processor ("RIP") would need to perform on a ROC-V thermal image in order to generate a gradient thermal plot in one embodiment.
Figure 10:
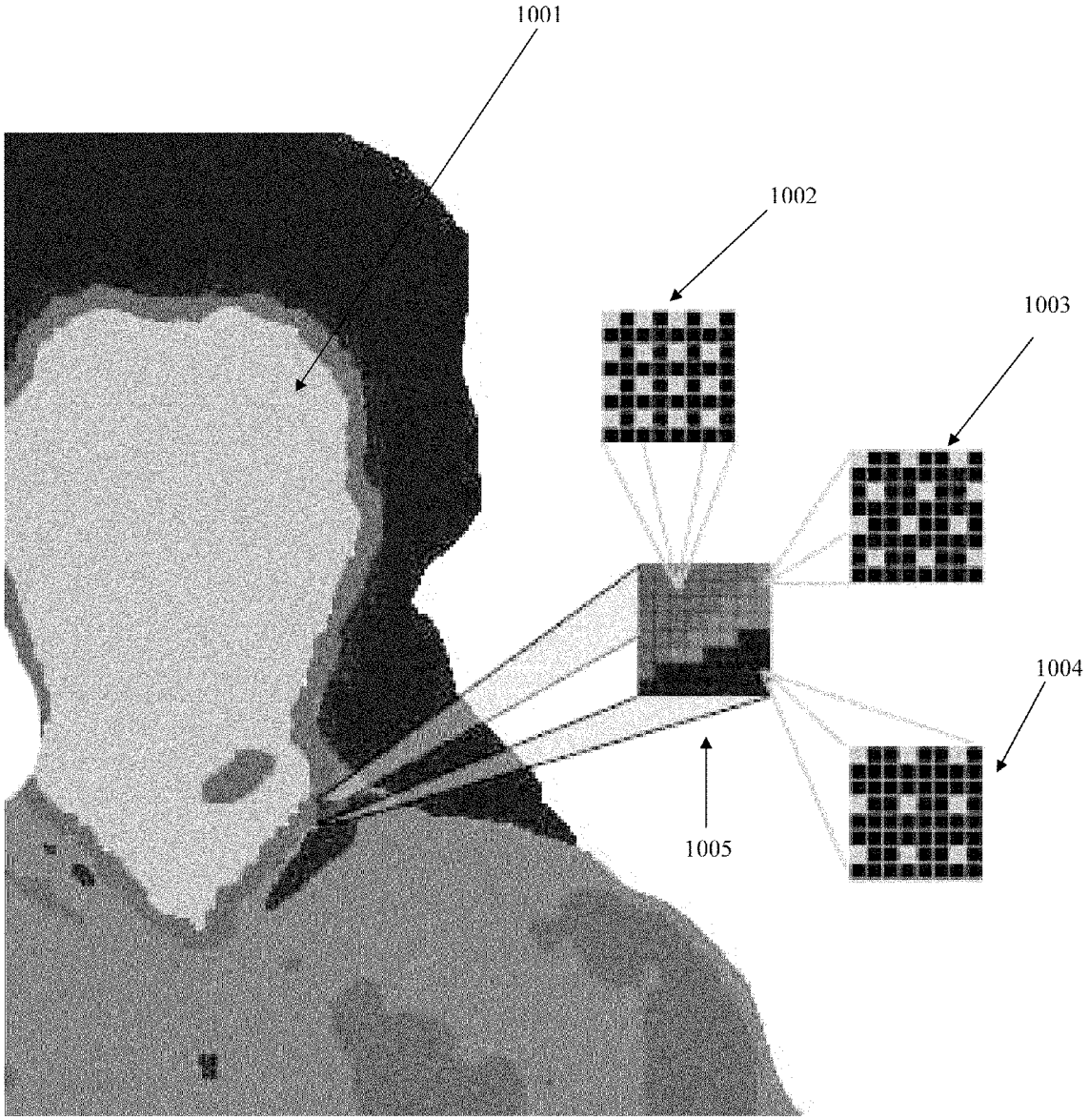
FIGS. 10 is an exploded diagram showing print patterns created by the hybrid head of a multiple print head resistive/conductive ink printer in one embodiment.

The RIP software may translate an image to digital rasterized bit maps where each bit represents a one (1) or a zero (0)

for each PTZ transducer in the print head. For example, an 8×8 print head may have 64 bits mapped in an 8×8 matrix. FIG. 9 shows a diagram of how the RIP software may work. First the RIP software may take in a ROC-V thermal image 901 and extract the luminance from each pixel in the image 902. That luminance value may then be translated into discrete levels of resistances using a lookup table or interpolation algorithm 903. The resistive ink lay down pattern may be determined by the ripping software as shown in FIG. 10-1002, Each color may represent a discrete resistance level. The ripping software may then map each discrete resistance level to resistive ink thickness 904 and generate an X-Y plot with ink densities or resistive/conductive ink blend ratios 905. Lastly it may output the data to the conductive ink printer/plotter 906. In a dual head system the resistive ink head may contain carbon black ink that may or may not contain a mixture of silver with it. The conductive ink head may contain pure silver ink and may lay down the conductive ink needed for the power busses as well as increasing the conductance of the resistive ink where needed.

In another exemplary embodiment a hybrid piezoelectric print head could be designed to contain both the resistive ink and the conductive ink side by side in the same head. The head may use calibrated picoliters of each type of ink to create the desired resistance at any location. The hybrid head may contain pure carbon black ink in the resistive nozzles and pure silver ink in the conductive nozzles as shown in FIG. 10. The two sets of nozzles may work in conjunction with each other. The exact picoliter of resistive ink may be deposited and then the exact amount of silver needed may be deposited in a same location. The combination of the two inks combined may result in a desired resistance for that location on the substrate. FIG. 10-1001 shows a zoomed in area of the image of FIG. 7. The color map of the selected area 1005 shows the intersection of three resistive ink segments of the thermal target. The 8×8 nozzle print head has both carbon black ink droplets as shown in 1002 black cells and silver droplets as shown in 1002 silver cells. The blue section of the color map may have a lowest conductance and may have 9 droplets of silver to every 64 droplets 1004.

The magenta section of the color map may be more conductive than the red section and may have 12 droplets of silver to every 64 droplets deposited 1003. And the red section of the color map may have a highest level of conductance has 16 droplets of silver to every 64 droplets deposited 1002. These droplet topographies are generated by the RIP software and when the entire target is imprinted on the plastic substrate and the 100% silver power busses printed a layer of non-conducting dielectric is needed as a final overcoat to hermetically seal the target from the environment. The dielectric nozzles could be contained in a separate head or built into the hybrid head and may be used as the last coat over the entire target. This system does not lend itself useful to just thermal targets. It also has applications in heaters, RFID tags, flex circuits, bubble switches, as well as pressure sensitive and capacitive touch applications.

In another exemplary embodiment, a gradient thermal target can be created using a varying thickness of conductive plastic. By molding or thermal forming the conductive plastic into a standalone target with varying thickness the currents within the target may be controlled in a same way the currents may be controlled by varying the thickness of the conductive ink. The conductive plastic can be created using a base resin like High Density Polyethylene ("HDPE") and a carbon black, carbon fibers, nickel fibers, or other conductive additive. This conductive plastic can be extruded into sheets that can be used for armored thermal target panels or thermal formed/injected molded into a fat Ivan or any other type of thermal target. The base polymer could be HDPE or Polyvinyl Chloride ("PVC") or any other ballistic tolerant plastic, To electrically connect to this type of thermal target one only needs to place two riveted connectors on opposite sides of the target base similar to that shown in FIG. 3-304. To prevent the target from shorting out to the chassis of a standard Stationary Infantry Target ("SIT") a non impregnated section of plastic can be molded or extruded or a layer of non-conducting tape can be used to insulate the base. Another technique may include using a non-conductive base sheet of HDPE and bond, using thermal forming or laminating process, a conductive layer of HDPE that is shorter than the non-conductive sheet at the base. The heating element formed by the conductive HDPE may be isolated from the base chassis by the exposed area of non-conductive HDPE at the base. In an exemplary embodiment, a thermal signature that is optimal for a human silhouette is 20 deg F. above ambient on the head/exposed skin and 10 deg F. above ambient on the clothed body. One skilled in art of plastics manufacturing may envision a multitude of different techniques for achieving this without deviating from the essence or spirit of the invention of the present application.

In an exemplary embodiment, the efficiency of the thermal target can be improved by adding a coating of a thermal sealant (for example a glass impregnated dielectric coating) over the conductive ink base or resistive plastic base on a thermal target. The thermal coating will add thermal hysteresis to the target and when combined with a Pulse Width Modulated ("PWM") power source it may create a low current, high thermal emission target. This is due to the ability of the thermal sealant to retain heat. Once the thermal target has come up to temperature the PWM may be cycled so that the average power delivered to the target is less than what it would have normally taken without the thermally retentive sealant. A closed loop system could be created by bonding a thermal sensor on the target and using it as a reference as to how much pulse width is needed to maintain desired thermal temperature. This is optimal for battery power thermal targetry systems.

A plastic substrate that has curved or flat surface could be coated with resistive/conductive traces forming a heating element right on the surface of the substrate using a resistive/conductive ink feed though a piezoelectric print head that is tied into a CNC controller. A thin film layer of resistive ink could have multiple passes applied to it creating varying thicknesses of ink. The ink thickness may determine its resistance at that location and may allow the temperature to be cooler where the effective resistance is lower and the temperature would be hotter where the effective resistance is higher. This could also be accomplished using silk screening with multiple passes of multiple masks. Each area of desired resistance would be created using a flood coating of resistive ink covering the entire area with a consistent thickness of ink, then cured in an oven and then the next mask may be placed over the existing cured resistive ink and another layer would be laid down on top of it. This new mask would be used to increase the thickness of ink in areas where you would want lower resistance or cooler temperatures.

Figure 11:
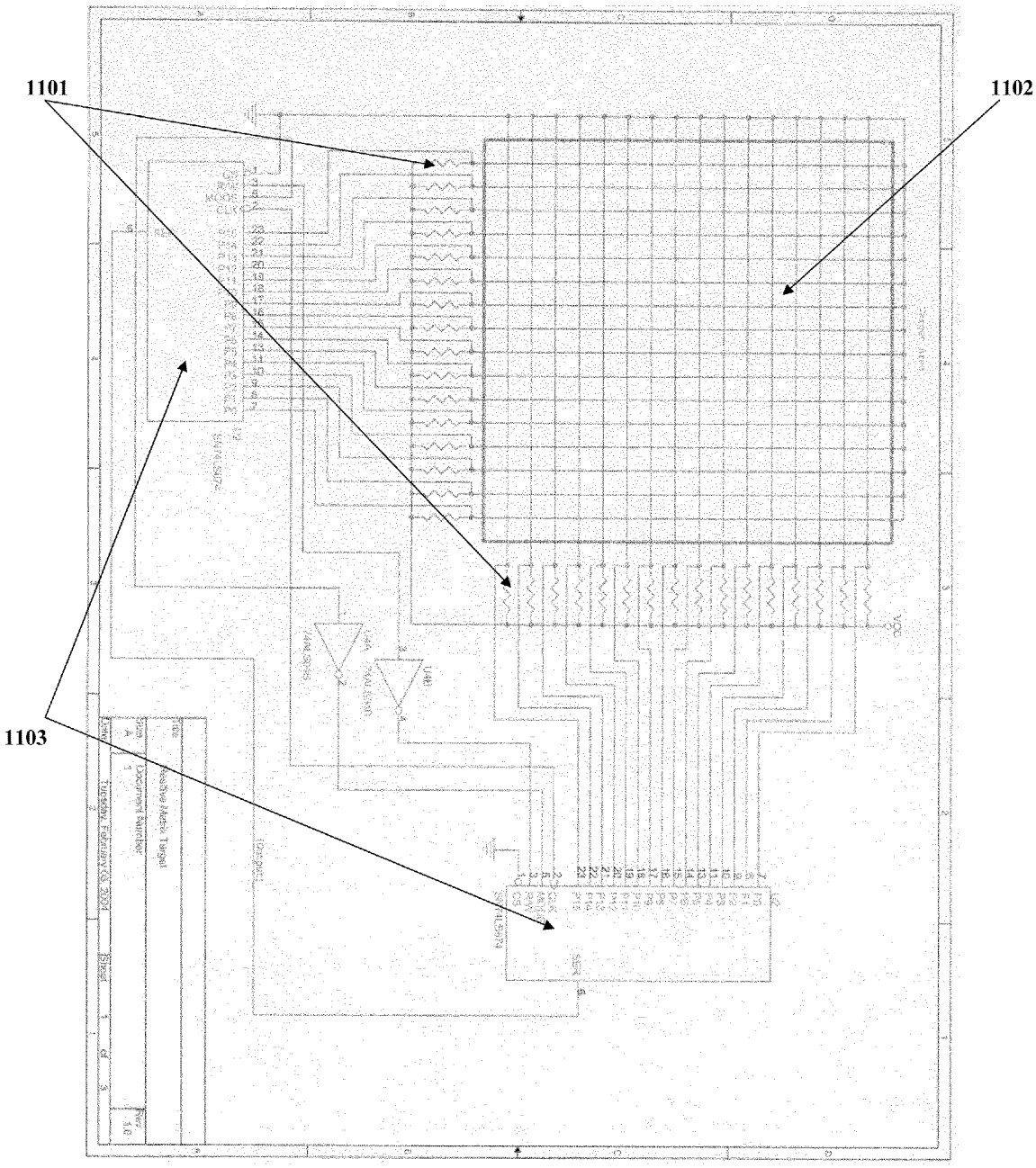
FIG. 11 is a circuit diagram showing detecting breaks in both rows and columns of conductive lines of a Digitally Discrete Target in one embodiment.

Using conductive ink, conductive foil, conductive plastic, or conductive wire a simple penetration location system may be built to locate where the thermal target or a stand alone membrane was hit with a projectile. FIG. 11 shows a schematic of an embodiment of the Digitally Discrete Target ("DDT") used to locate the projectiles position of penetration. The shift registers 1103 inputs may be tied to pull up resistors 1101 that are brought to ground potential using conductive ink, foil or wire 1102. These grounding traces can be inked onto a substrate having the horizontal traces inked on one side and the vertical traces inked on the other side. In an alternative exemplary embodiment, it could be insulated wire weaved in and out of the thermal target in between the resistive/conductive traces. In an alternative exemplary embodiment, insulated wires may be placed both horizontally and vertically under the thermal heating element. Once a projectile breaks a row and column ground trace/wire the pull up resistor pulls the shift register's input high and shifts the data out serially to a microprocessor that can determine where the target was penetrated by the location of 1 bits in the serial stream of bits. This type of target could be easily repaired by patching the hole created by the projectile and painting new conductive traces or solder a connecting wire to reconnect the circuit to ground. The substrate used can be made from blown/extruded film plastic membrane or simply a standard tarp type material. The electronics can be attached to the target using simple alligator clips making it inexpensive to repair and replace the target. This system can be augmented/overlaid with RMT technology, as disclosed in U.S. Pat. No. 5,516,113, to improve accuracy and response time. This penetration location system may be utilized in armored vehicle targets to automate calibration of the bore sight of tanks. The calibration curves could be derived from the X-Y location of impact and a correction table could be uploaded into a tank's bore sight control system's calibration table automatically without any operator intervention. This may reduce an amount of ammunition needed as well as significantly cut down on the time it takes to calibrate the tank's bore sight. This location sensor can be combined with any of these thermal technologies to create a thermal target with scoring capability.

Figure 12:
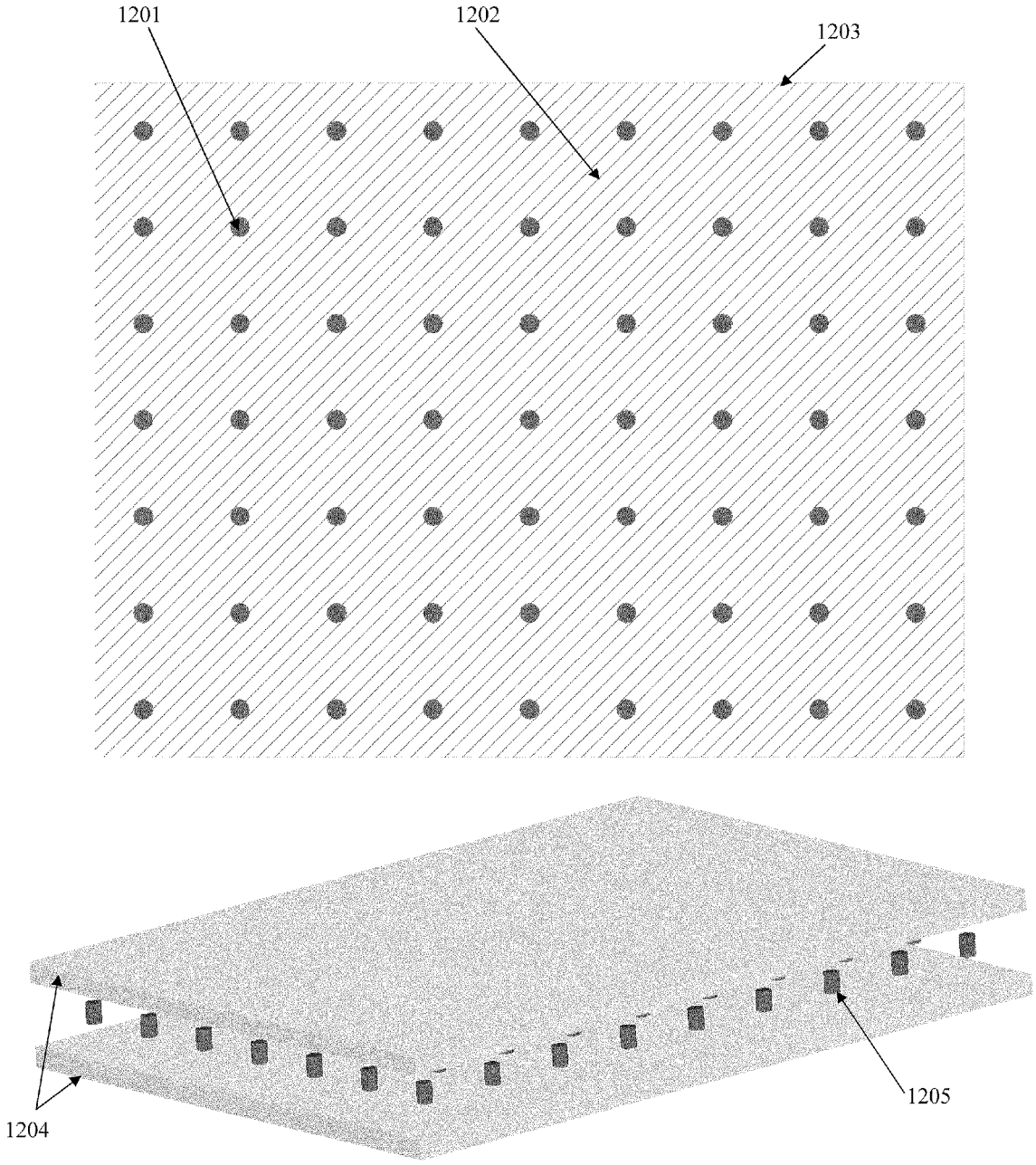
FIG. 12 is a diagram showing a gradient thermal target that uses resistive layer in the Z axis in one embodiment.

In another exemplary embodiment, a thermal target can be created by sandwiching resistive membrane/plastic between two conductive membranes or plates formed from conductive ink. FIG. 12-1203 shows a transparent top view of this embodiment. The conductive plates 1204 as seen in the isometric view may be formed from conductive ink being flood coated onto a thin plastic substrate (not shown). The small segments of resistive ink/membrane 1201 are spaced at short intervals and the space between them is filled in with an inert dielectric filler 1202 to prevent the 2 plates from shorting out to each other. A potential is applied between the top and bottom plate causing the resistive membrane/ink segments to heat up. Since each resistive segment is in parallel with each other segment 1205 a relatively low resistance results across the plates. A benefit of this embodiment is that the plates are facing perpendicular to the direction of penetration. This allows the thermal target power busses to cover then entire target making extremely robust against having a projectile(s) severing one of the power busses supplying power to the target.

Figure 13:
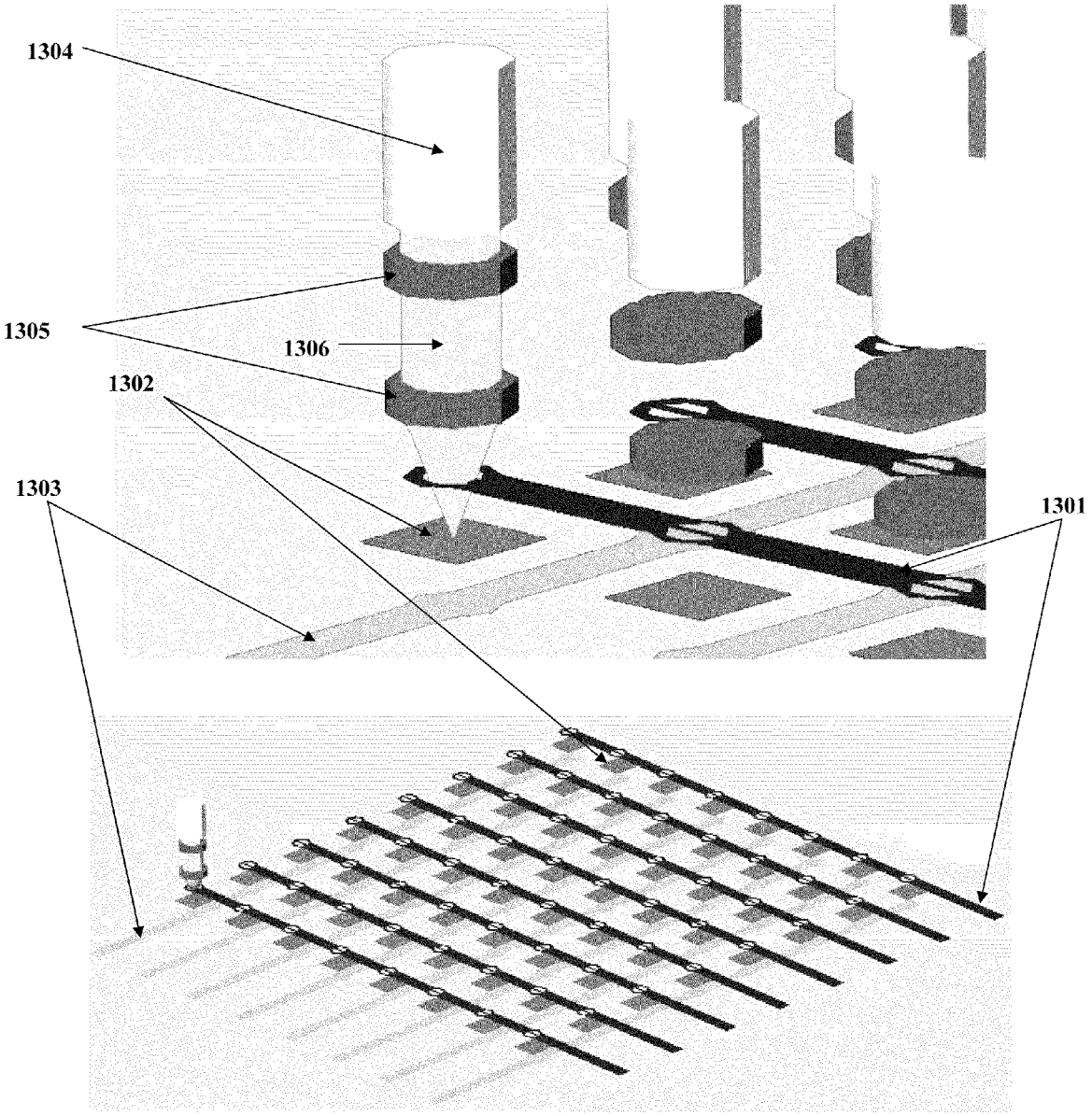
FIG. 13 shows conductive traces, photo sensitive resistors, laser and focal lenses of a programmable thermal simulator in one embodiment.

In another exemplary embodiment a programmable heat signature generator can be created by using light sensitive membrane laminated between 2 conductive traces as shown in FIG. 13. The horizontal conductive trace 1303 is laminated onto the plastic substrate 1301. The optically resistive ink 1302 is deposited onto the horizontal conductive traces. The optical resistive ink could be comprised of a colloidal suspension type ink containing any suitable optically sensitive materials, including by not limited to: Cadmium Sulfide, Indium gallium arsenide, Lead sulfide, Indium arsenide, Platinum silicide, Indium antimonide, and Mercury cadmium telluride. The vertical conductive traces 1301 may be deposited onto the resistive ink layer. Therefore both conductive traces on each side of the light sensitive membrane may make contact to the light sensitive membrane 1302 and have a voltage potential difference placed across them. A matrix of lasers/laser diodes 1304 may be placed above the horizontal conductive trace and when excited may inject the beam 1306 though two focusing lenses 1305 onto the horizontal conductive traces opening. The light sensitive membrane resistance decreases when exposed to light, either visible or invisible, causing the light sensitive membrane to heat up. By pulsing the lasers on and off the thermal pixel will get warmer the longer you leave the beam on relative to the time you leave it off. By creating a reflective display with this composite membrane and exciting it with a digital light processing ("DLP") or liquid crystal on silicon ("LCoS") or laser source any suitable type of thermal signature may be created. Alternatively, another type of reflective display could be made with a photosensitive material that converts light to heat directly. For example, a thin black sheet of plastic with a static picture projected on the back may produce a thermal signature just from the energy absorbed by the black plastic. One skilled in the art of plastics manufacturing may produce a multitude of different techniques for achieving this and not deviate from the essence or spirit of the invention of the present application.

Figure 14:
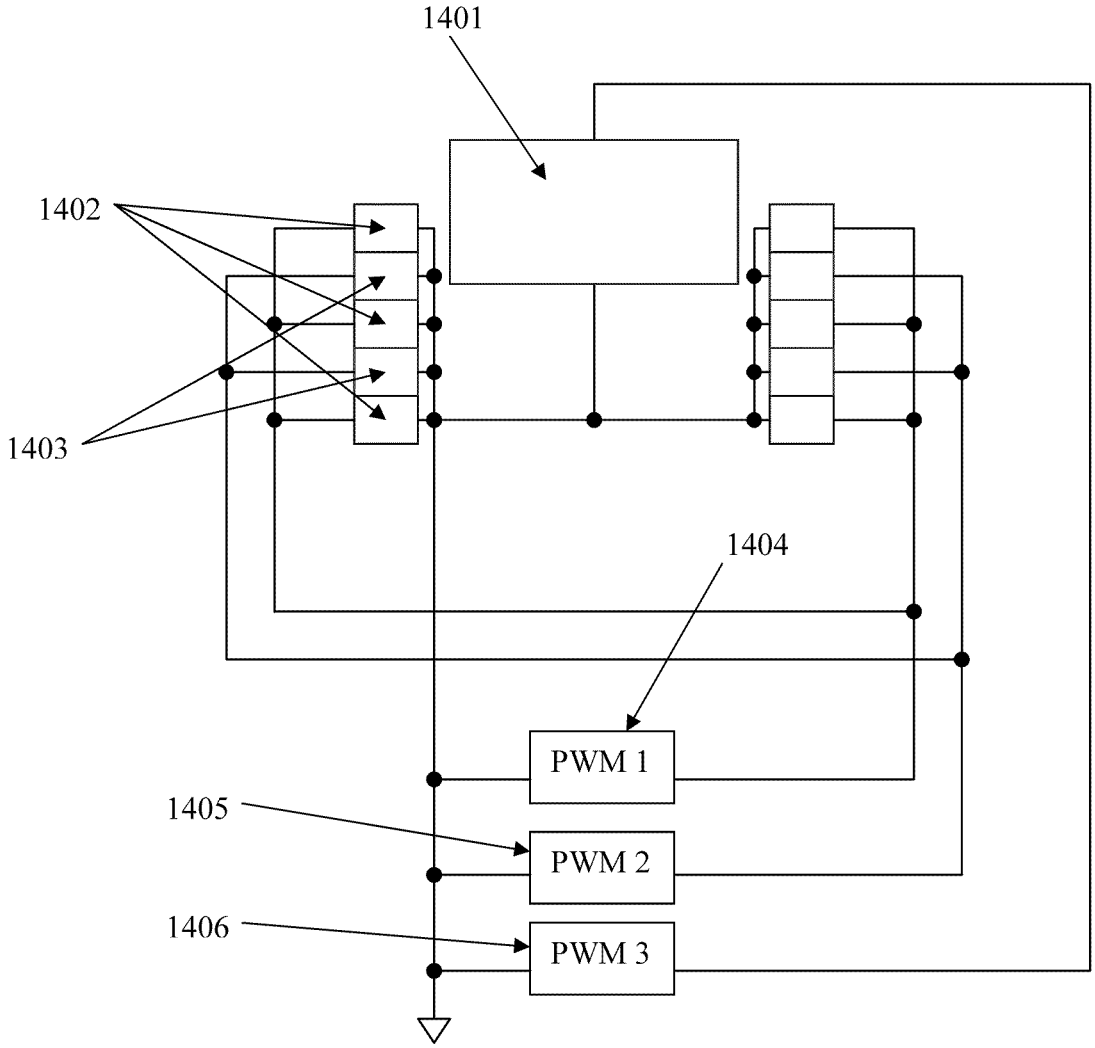
FIG. 14 shows an embodiment of programmable thermal target using multiple PWM to control the thermal image.
Figure 15:
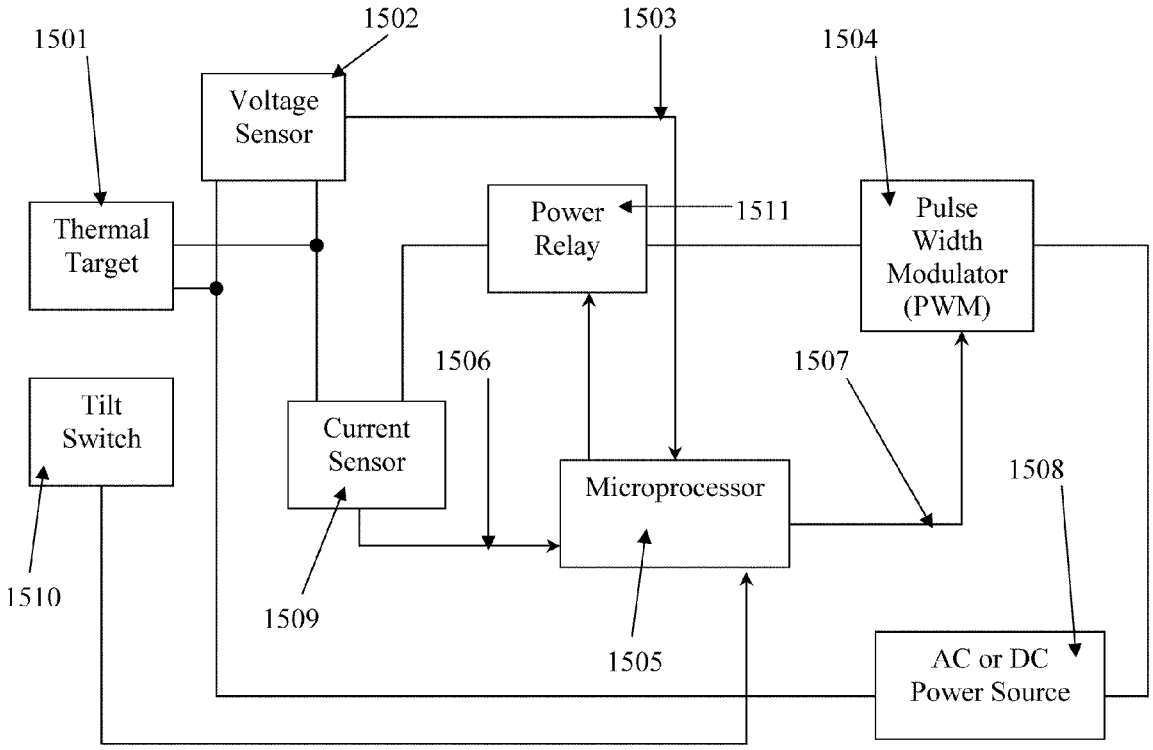
FIG. 15 is block diagram showing components of a Power On Demand ("POD") Target Power Unit ("TPU") in one embodiment.

In another exemplary embodiment, a thermal target can be constructed to emit a thermal signature that appears to be moving. FIG. 14 shows a simulated tank target using multiple thermal panels. The main torrent/engine panel 1401 is powered by a separate Pulse Width Modulated ("PWM") power source 1403. Each pulse width modulator allows for individual control of a single panel or group of panels ganged together. When the PWM source is at 0% duty cycle the panel(s) is turned off and when the PWM source is at 100% duty cycle the panel(s) is fully powered. The group of panels 1402 and interlaced group of panels 1403 are grouped together to create the tank tracks having the illusion of movement by alternating duty cycle so that when one group of panels is at 100% duty cycle the other panels are at 0% duty cycle and visa versa. By continuously cycling PWM1 & PMW2 an alternating thermal image is generated giving the illusion that the tracks of the tank are in motion. Pulse width modulation can be used to power thermal targets and reduce the accuracy needed in manufacturing the target resistive membrane. The PWM can also add life to the thermal target by keeping it continuously powered as its resistance drops from bullet penetrations. The PWM can be used to create a constant power target power unit ("TPU"). The constant power TPU may include the components shown in FIG. 15. The thermal target 1501 may have a current sensor 1509 tied in series with the PWM 1504. The target may also include a voltage sensor 1502 tied across its inputs. The AC or DC power source 1508 supplies power for the TPU. The microprocessor 1505 monitors the output from the current sensor 1506 and the voltage sensor 1503. The microprocessor outputs a control signal 1507 to the PWM to adjust the Pulse Width so that the power delivered to the target remains constant. There are many combinations of these types of techniques for achieving this invention while not deviating from the core essence or spirit of this invention. For example if the power source is AC a silicon controlled rectifier SCR, thyristor or triac could be used as the PWM.

Power on Demand TPU can be created using a PWM as well. A tilt switch sensor 1510 may be tied into the microprocessor 1505 so that it can monitor the targets position. When the target is lying down in the horizontal position the tilt switch sensor will be closed and the microprocessor can disconnect the power to the target using the power relay 1511 that is connected in series with the PWM. Once the microprocessor detects the target rising from its horizontal position the microprocessor will drive the PWM momentarily to 100% duty cycle forcing the target to rapidly come up to temperature while it is rising. Once in the vertical position the microprocessor would return the PWM back to its normal operating range of 50% to 60% duty cycle. This type of Power On Demand TPU may save a significant amount of energy and reduce overall cost of maintaining the targeting system. In another embodiment of a Power On Demand TPU a pre-command could be sent to the microprocessor informing it to power the target and raise it in a predetermined period of time, for example, in one minute. That pre-command could be sent manually or by the range battlefield simulation sequencer; in such a configuration the target will not rise immediately upon command so it may be triggered a predetermined period of time before rising is desired. The tilt switch sensor would still turn off the target in the horizontal position as before. If a regeneration generator is used to recharge the batteries in a DC Power Source it could be controlled by the microprocessor and only turn the generator on when needed and turn the generator off when fully charged, saving resources and reducing operator intervention needed to maintain the target system.

Figure 16:
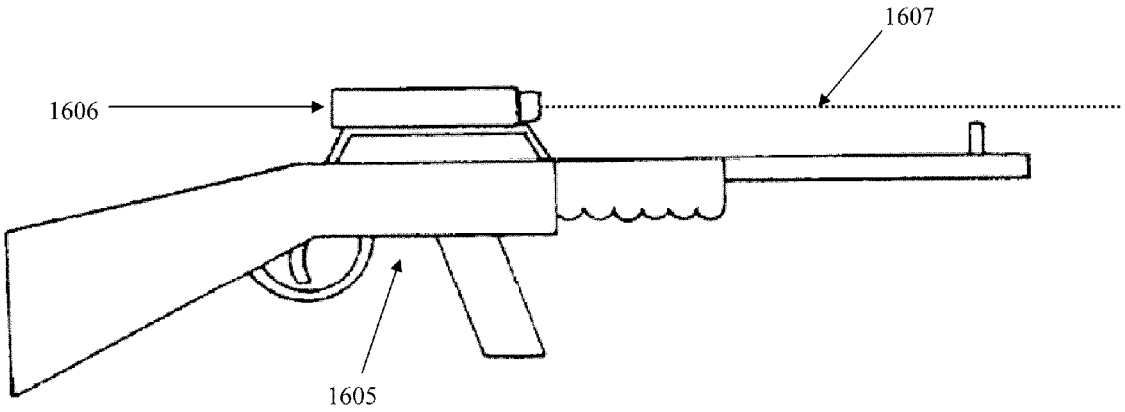
FIG. 16 is an diagram of the laser fired force-on-force training weapon and an isometric diagram showing the laser detection matrix of the target in one embodiment.
Figure 16:
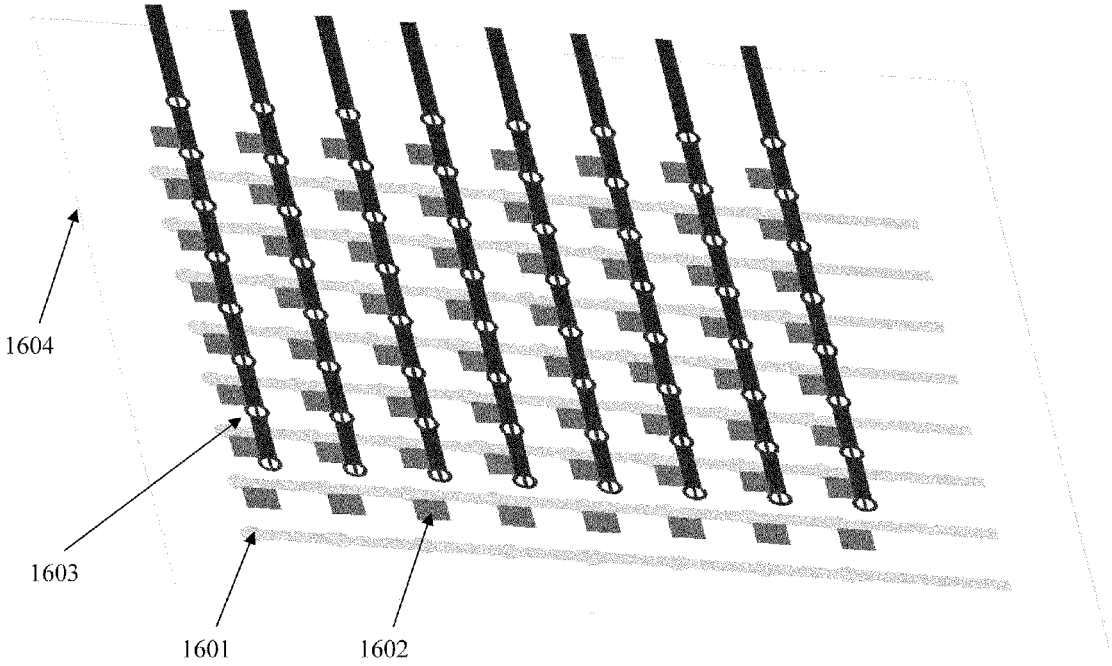
Figure 17:
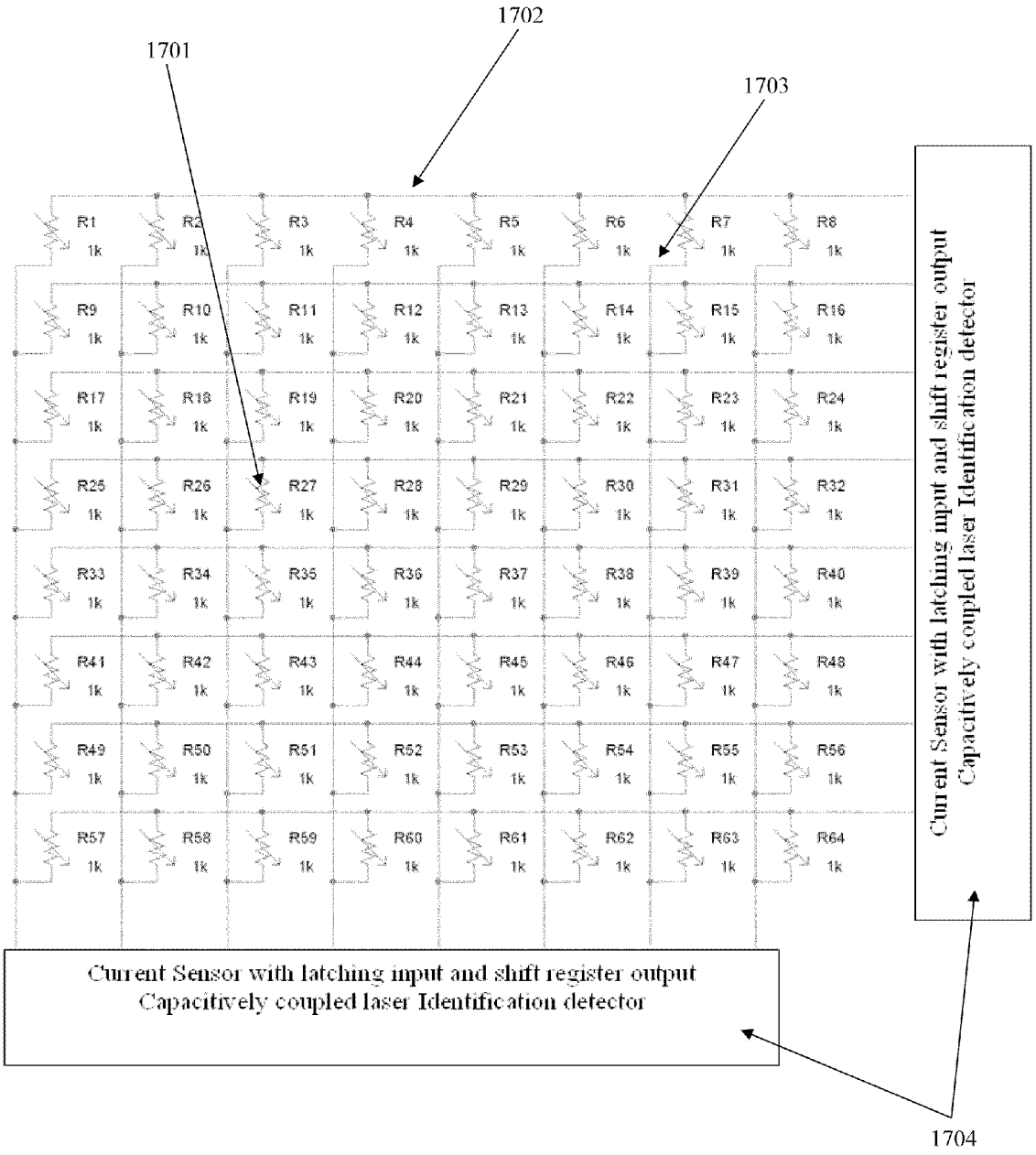
FIG. 17 is a block diagram showing a circuit used to detect a laser impact and to decode an X-Y location and identify a weapon ID in one embodiment.

In another embodiment a thermal target could be augmented with a laser detection membrane layer that would detect laser impact location and identify the gun that shot the target. Thereby, where the target was hit with a laser may be determined; the gun may be identified; its lethality may be scored; and the target may be dropped if lethally hit, in one operation. Since the thermal target is not being impacted with bullets it can be used over and over again without having to change out the heating membrane and can act as a reusable stand alone non-thermal scoring target as well. The exemplary target shown in FIG. 16-1604 may be composed of a plastic substrate 1604 with a purely conductive trace bonded to it horizontally 1601. The active optical detector 1602 may be laminated on top of the horizontal conductive traces and act as an insulator between the horizontal traces and the vertical traces 1603. The optical detector could be comprised of a colloidal suspension type ink containing any suitable optically sensitive materials, including but not limited to: Cadmium Sulfide, Indium gallium arsenide, Lead sulfide, Indium arsenide, Platinum silicide, Indium antimonide and Mercury cadmium telluride. The vertical traces may have an opening 1603 allowing light to hit the optical detector and change its resistance or conductance. When the resistance between the horizontal conductive traces and the vertical conductive traces changes the current sensors will detect that change latch the respective horizontal and vertical input. It will also capture the laser identification number by taking the modulated signal and capacitively coupling it to a phase-lock loop driven decoder. The frame synch pattern embedded in the header of the modulated laser signal would cause the phase lock loop output to sync and generate a synchronized sample clock. The modulated signal would then be shifted into a 16 or 32 bit shift register using that synchronized sample clock and latch it into the laser ID shift register. Both the laser ID shift register and X-Y location shift registers will serially send back their data to the control system for analysis. The laser beam gets its identification from the laser modulator FIG. 16-1606 which is modulated with a repetitive frame sync code and identification number sequence. Each laser modulator may have a unique identification number stored in non-volatile ram. The target control system would log the identification of the shooter and associate the gun identification number with that shooter. The laser beam being projected out of the gun 1607 and onto the target would occur only when the trigger has been pressed. For example FIG. 17 shows the schematic of the target sensor and in that moment in time when the trigger was pressed the laser beam hit R27 1701 a current change would occur in row 4's current sensor's input and column 3's current sensor's input. The current would cause the horizontal 1702 latched shift register 1704 input $4^{th}$ bit to set and the $3^{rd}$ bit of the vertical 1703 latched shift register 1704 would set. The laser identification may be decoded and set into the laser ID shift register 1704 and all 3 shift registers would shift out their data to the control system.

Once sent all the latched inputs and shift registers may be cleared. In an exemplary embodiment, if there is a problem with simultaneous hits by multiple soldiers, a FIFO register can be placed between the detectors and the shift registers and a counter can be added for time stamping. The FIFO may shift out the data as fast as it can and allow for simultaneous hits. If the laser detection system is combined with MRL technology, it may be determined both where the laser hit, the bullet hit and which gun was fired on a live fire range. This may be utilized for calibrating sniper rifles. Additionally, the control system could take in the wind velocity, temperature and barometer reading to use for statistical analysis of environmental effects on accuracy. The same material used in the target could be bonded to TyVek©, or cloth to create a highly accurate vest for simulated force-on-force training. The system would use the GPS and tracking system described as the SenseSuit© technology disclosed in U.S. Pat. No. 7,207,566, incorporated herein in its entirety. One skilled in the art of silk screen printing and/or data acquisition may envision a multitude of different processes/methods and not deviate from the essence or spirit of the invention of the present application.

Figure 18:
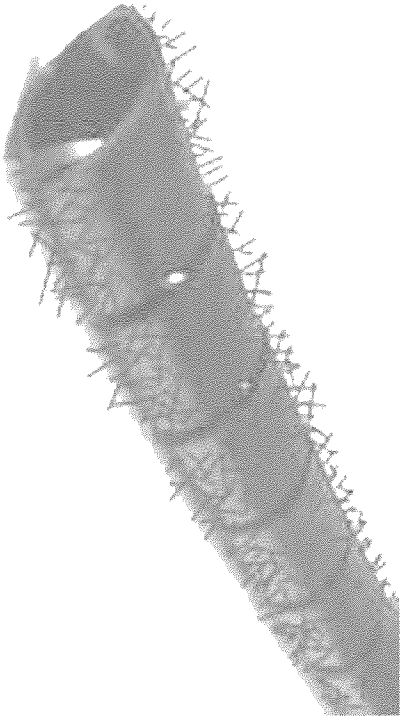
FIG. 18 is a block picture of a spiked spiral wrap cable harness used to prevent rodents from eating into the thermal target power wires in one embodiment.

When installing thermal targets, for instance by locating them on desert ranges, the power cables leading from the target power unit to the thermal target may be damaged by rodents that gnaw or chew on the wiring harnesses. Such rodents can cause enough damage to the wiring that the entire cable harnesses has to be replaced. FIG. 18 shows a spiked spiral wrap or split loom which in this embodiment is made out of nylon, polyethylene, or any other suitable plastic or plastic-like material, with a plurality of embedded spikes made of nylon, polyethylene, or any other suitable plastic or plastic-like material. Alternatively, the spiked spiral wrap or split loom and/or the embedded spikes may be constructed out of material such as metal, carbon fiber, rubber, or any other suitable material that allows enclosure of the wiring. The spikes irritate the rodents' noses and prevent them from sinking their teeth into the wires below the spiked spiral wrap or split loom. Such a spiked spiral wrap or split loom may be implemented as a retrofit for existing cable harnesses and may be relatively convenient to manufacture. One skilled in the art of plastic manufacturing may recognize that a multitude of different variations exist for configuration of such a spiked spiral wrap or split loom, without deviating from the essence or spirit of the invention of the present application.

As will be understood by one skilled in the art, the present application is not limited to the precise exemplary embodiments described herein and that various changes and modifications may be effected without departing from the spirit or scope of the application For example, elements and/or features of different illustrative embodiments may be combined with each other, substituted for each other, and/or expanded upon within the scope of the present disclosure and the appended claims. In addition, improvements and modifications which become apparent to persons of ordinary skill in the art after reading the present disclosure, the drawings, and the appended claims are deemed within the spirit and scope of the present application.

What is claimed is:

1. A thermal target system comprising:

a first conductive, resistive portion comprising first traces of conductive, resistive ink connected to a first electrical buss and a second electrical buss coupled to a source of electrical current to produce a first thermal image, each of said first traces spaced from each of said other first traces and each of said first traces extending from said first buss to said second buss;

a second conductive, resistive portion comprising second traces of conductive, resistive ink connected to said first electrical buss and said second electrical buss coupled to the source of electrical current to produce a second thermal image, each of said second traces spaced from each of said other second traces and each of said second traces extending from said first buss to said second buss; and said first traces and said second traces having different thicknesses relative to each other such that said first conductive, resistive portion and said second conductive, resistive portion have different resistances relative to each other and such that said first thermal image is different from said second thermal image, wherein a combined first thermal image and second thermal image mimics a desired thermal signature;

said first conductive, resistive portion and said second conductive, resistive portion bonded to a sheet to form a target to be releasably connected to an object.

2. The system of claim 1 further comprising an electrical controller coupled to said first conductive, resistive portion and said second conductive, resistive portion to selectively control a flow of electrical current to said first conductive, resistive portion and said second conductive, resistive portion to selectively control said combined thermal image.

3. The system of claim 1 wherein said first conductive, resistive portion and said second conductive, resistive portion are electrically insulated relative to each other.

4. The system of claim 1 wherein said first conductive, resistive portion and said second conductive, resistive portion are electrically connected to each other.

5. The system of claim 1 wherein said first conductive, resistive portion comprises a light sensitive resistive membrane.

6. The system of claim 1 wherein the desired thermal signature comprises a friend or a foe and said combined thermal image is selectively displayable to mimic said thermal signature of said friend or said foe.

7. The system of claim 1 further comprising a penetration location system coupled to said object and electronically providing a determination of a location of a point of penetration of said object and providing an indication of the determination on a display.

8. The system of claim 1 further comprising a graphic image superimposed on said first conductive, resistive portion and said second conductive, resistive portion to mimic a desired appearance on said object, said graphic image aligned with said first conductive, resistive portion and said second conductive, resistive portion such that said combined thermal image and said graphic image mimic a same desired representation on said object.

9. The system of claim 8 wherein said graphic image is laminated on said first conductive, resistive portion and said second conductive, resistive portion.

10. The system of claim 1 wherein said first conductive, resistive portion and said second conductive, resistive portion are located in a first layer and further comprising a second layer having a third conductive, resistive portion coupled to a source of electrical current to produce a third thermal image mimicking a second desired thermal signature.

11. The system of claim 10 further comprising an electrical controller coupled to said first conductive resistive portion, said second conductive, resistive portion and said third portion to selectively control a flow of electrical current to said first conductive resistive portion, said second conductive, resistive portion and said third conductive resistive portion to selectively control said combined thermal image and said third thermal image to mimic at least one of said desired thermal signature and said second desired thermal signature.

12. The system of claim 1 further comprising a laser detection membrane layer on said object and coupled to at least one laser gun, said layer comprising a light sensitive resistive membrane between two conductive materials, said membrane coupled to a controller configured to provide location information relative to an impact of a laser on said membrane from said at least one laser gun.

13. The system of claim 12 wherein said layer comprises a laser identification sensor and said controller is configured to provide an identification of said at least one laser gun based on information received from said laser identification sensor.

14. The system of claim 1 wherein said first conductive, resistive portion and said second conductive, resistive portion are located on said object such that said first conductive, resistive portion and said second conductive, resistive portion directly contact said object.

15. The method of claim 1 wherein said first traces and said second traces having different thicknesses relative to each other comprises said first traces and said second traces having different widths relative to each other.

16. A method comprising:

printing a first conductive, resistive portion comprising first traces of conductive, resistive ink on a sheet to connect said first conductive, resistive portion to a first electrical buss and a second electrical buss coupled to a source of electrical current to produce a first thermal image, each of said first traces spaced from each of said other first traces and each of said first traces extending from said first buss to said second buss;

printing a second conductive, resistive portion comprising second traces of conductive, resistive ink on the sheet to connect the first electrical buss and the second electrical buss coupled to the source of electrical current to produce a second thermal image, each of said second traces spaced from each of said other second traces and each of said second traces extending from said first buss to said second buss;

said first traces and said second traces having different thicknesses relative to each other such that the first conductive, resistive portion and the second conductive, resistive portion have different resistances relative to each other and such that the first thermal image and second thermal image are different relative to each other and produce a combined thermal image to mimic a desired thermal image on the object; and releasably attaching the sheet to an object to form a target on said object.

17. The method of claim 16 further comprising selectively controlling a flow of the electrical current to at least one of the first conductive, resistive portion and the second conductive, resistive portion to produce a different combined thermal image.

18. The method of claim 17 wherein the combined thermal image comprises a foe target and the different combined thermal image comprises a friend target.

19. The method of claim 16 further comprising selectively controlling a flow of the electrical current to at least one of the first conductive, resistive portion and the second conductive, resistive portion using a controller to selectively control the combined thermal image.

20. The method of claim 16 further comprising providing a second combined thermal image to mimic a second desired thermal signature by selectively controlling a flow of the electrical current to at least one of the first conductive, resistive portion and the second conductive, resistive portion using a controller.

21. The method of claim 16 further comprising electrically insulating the first conductive, resistive portion relative to the second conductive, resistive portion.

22. The method of claim 16 further comprising a third conductive, resistive portion coupled to the source of electrical current, and further comprising controlling a flow of the electrical current to at least one of the first conductive, resistive portion, the second conductive, resistive portion, and the third conductive, resistive portion to produce a second combined thermal image mimicking a second desired thermal signature on the object.

23. The method of claim 16 further comprising coupling a penetration location system to the first conductive, resistive portion and the second conductive, resistive portion to provide a determination of a location of a point of penetration of at least one of the first conductive, resistive portion and the second conductive, resistive portion.

24. The method of claim 16 further comprising coupling a laser detection membrane layer to the first conductive, resistive portion and the second conductive, resistive portion to provide a determination of a location of an impact location of a laser emitted by at least one laser gun.

25. The method of claim 24 wherein the membrane layer comprises a light sensitive resistive membrane between two conductive materials, the membrane coupled to a controller and further comprising the controller providing location information relative to an impact of a laser on the membrane from the at least one laser gun.

26. The method of claim 25 wherein the membrane comprises a laser identification sensor and further comprising the controller providing an identification of the at least one laser gun based on information received from the laser identification sensor.

27. The method of claim 16 further comprising locating the first conductive, resistive portion and the second conductive, resistive portion on the object such that the first conductive, resistive portion and the second conductive, resistive portion directly contact the object.

28. The method of claim 16 wherein said first traces and said second traces having different thicknesses relative to each other comprises said first traces and said second traces having different widths relative to each other.

29. A thermal target system comprising:

a first conductive, resistive portion comprising a first plurality of conductive, resistive ink traces having a first thickness and connected to a first electrical buss and a second electrical buss coupled to a source of electrical current such that said first conductive, resistive portion produces a first thermal image on a sheet;

a second conductive, resistive portion comprising a second plurality of conductive, resistive ink traces having a second thickness and connected to the first electrical buss and the second electrical buss coupled to the source of electrical current such that said second conductive, resistive portion produces a second thermal image on said sheet; and said first thickness and said second thickness being different relative to each other such that said first conductive, resistive portion and said second conductive, resistive portion have different resistances relative to each other and such that said first thermal image is different from said second thermal image, wherein a combined first thermal image and second thermal image mimics a desired thermal signature on a target formed by said sheet attached to an object.

30. The system of claim 29 wherein said first thickness comprises a first width and said second thickness comprises a second width.

31. A thermal target system comprising:

a first conductive, resistive portion connected to a first electrical buss and a second electrical buss coupled to a source of electrical current to produce a first thermal image on an object;

a second conductive, resistive portion connected to the first electrical buss and the second electrical buss coupled to the source of electrical current to produce a second thermal image;

said first conductive, resistive portion formed of first conductive, resistive ink traces and said second conductive, resistive portion formed of second conductive, resistive ink traces, said first conductive, resistive ink traces and said second conductive, resistive ink traces having different thicknesses relative to each other such that said first conductive, resistive portion and said second conductive, resistive portion have different resistances relative to each other and such that said first thermal image is different from said second thermal image; and said second conductive, resistive portion superimposed on said first conductive, resistive portion such that said second thermal image is superimposed on said first thermal image, wherein a combined first thermal image and second thermal image mimics a desired thermal signature on said object.

32. The method of claim 31 wherein said first conductive, resistive ink traces and said second conductive, resistive ink traces having different thicknesses relative to each other comprises said first conductive, resistive ink traces and said second conductive, resistive ink traces having different widths relative to each other.

* * * * *